US007974551B2

(12) United States Patent
Nishimura

(10) Patent No.: US 7,974,551 B2
(45) Date of Patent: Jul. 5, 2011

(54) DEVELOPING DEVICE HAVING SEPARABLE TWO HOUSING PIECES AND IMAGE FORMING APPARATUS PROVIDED WITH THE SAME

(75) Inventor: Toshinori Nishimura, Osaka (JP)

(73) Assignee: Kyocera Mita Corporation (JP)

( * ) Notice: Subject to any disclaimer, the term of this patent is extended or adjusted under 35 U.S.C. 154(b) by 448 days.

(21) Appl. No.: 12/030,909

(22) Filed: Feb. 14, 2008

(65) Prior Publication Data

US 2008/0199220 A1 Aug. 21, 2008

(30) Foreign Application Priority Data

Feb. 15, 2007 (JP) ..... 2007-035557

(51) Int. Cl.
*G03G 21/18* (2006.01)
*G03G 15/00* (2006.01)

(52) U.S. Cl. ..... 399/113; 399/110

(58) Field of Classification Search ..... 399/222, 399/110, 113, 260, 263
See application file for complete search history.

(56) References Cited

U.S. PATENT DOCUMENTS 4,891,671 A * 1/1990 Iwamasa ..... 399/257
5,283,542 A * 2/1994 Ochiai et al. ..... 335/6
2002/0191982 A1* 12/2002 Tsukamoto et al. ..... 399/94
2003/0012583 A1* 1/2003 Okoshi ..... 399/119

* cited by examiner

*Primary Examiner* — David P Porta
*Assistant Examiner* — Carolyn Igyarto
(74) *Attorney, Agent, or Firm* — Gerald E. Hespos; Michael J. Porco

(57) ABSTRACT

A developing device is provided for an image forming apparatus that has a photoreceptor. The developing device has a housing with upper and lower housing pieces that are snap fit together. A developer opening is formed in an upper portion of the upper housing piece for supplying a developer and a bottom opening is formed in a bottom part of the upper housing piece. A developer carrier and a developer agitating member are supported rotatably in the upper housing so that an axis of the developer agitating member is below an axis of the developer carrier and below the developer opening. The lower housing piece is configured to seal the bottom opening of the upper housing piece. However, the snap fit housings can be separated for cleaning as necessary.

18 Claims, 12 Drawing Sheets

DEVELOPING DEVICE HAVING SEPARABLE TWO HOUSING PIECES AND IMAGE FORMING APPARATUS PROVIDED WITH THE SAME

BACKGROUND OF THE INVENTION

1. Field of the Invention

The present invention relates to an image forming apparatus using an electrophotography method including a copying machine, a printer, a facsimile machine, and a multifunction device of a combination thereof, and a developing device used therein.

2. Description of the Related Art

In an image forming apparatus using an electrophotography method including a copying machine, a printer, a facsimile machine, and a multifunction device of a combination thereof, a developing device is used for developing a latent image formed on a photoreceptor. The developing device includes a developer carrier that carries developer and faces to the photoreceptor, a layer thickness regulating member that regulates a developer layer thickness, and an agitating member that agitates the developer pooled in a developer tank placed in a housing of the developing device.

Differing from that of a toner cartridge, importance has not been placed on recycling efficiency of the such developing devices. Therefore, the housing of the developing device including therein the developer carrier and the agitating member is not considered of its easy disassembly and cleaning of an internal surface after the disassembly.

SUMMARY OF THE INVENTION

An object of the present invention is to provide a developing device excellent in recycling efficiency and an image forming apparatus to which the developing device is applied.

The developing device according to an aspect of the invention which attains the aforementioned object includes a housing with an opening portion for supplying developer; a developer carrier rotatably placed within the housing; and a developer agitating member rotatably placed within the housing in order to agitate and electrically charge the developer. The housing is formed such that a first housing piece and a second housing piece are coupled to each other in a detachable manner. The first housing piece provided therein with the opening portion and a sealed opening portion supports the developer carrier and the developer agitating member in a rotatable manner and the second housing piece is coupled with the first housing piece so as to seal the sealed opening portion, and the first housing piece and the second housing piece are coupled to each other through a snap fit joint.

The image forming apparatus with the developing device having the above described configuration according to another aspect of the invention includes: a photoreceptor on which a latent image is formed by an electrophotography method; and a developing device for supplying developer to the photoreceptor.

BRIEF DESCRIPTION OF THE DRAWINGS

FIG. 5A is a perspective view of a housing bottom portion viewed from an inner surface side; FIG. 5B is a perspective view of the housing bottom portion viewed from an outer surface side; and FIG. 5C is a perspective view of a housing upper portion viewed from a bottom portion side, respectively.

DETAILED DESCRIPTION OF THE PREFERRED EMBODIMENTS

Figure 1:
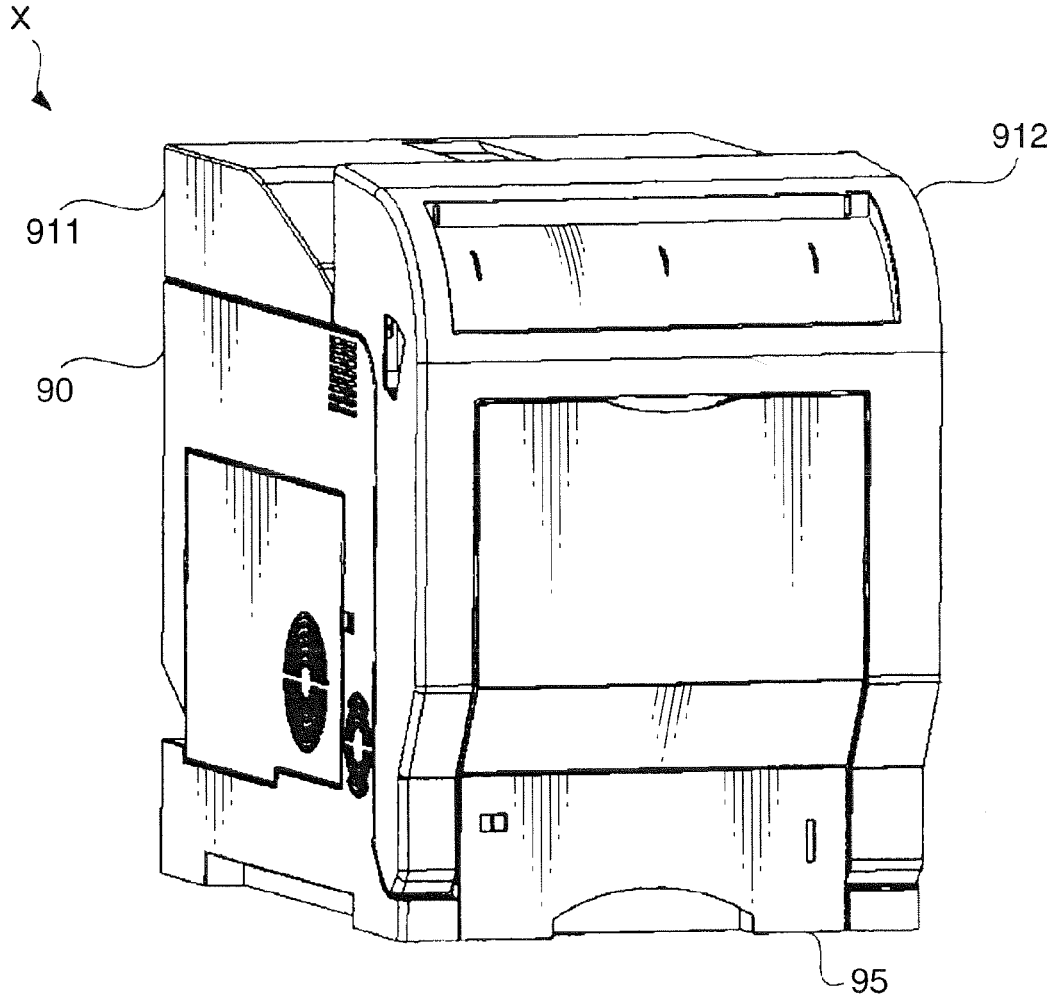
FIG. 1 is an outer perspective view of a multicolor printer according to an embodiment of an image forming apparatus of the invention.
Figure 2:
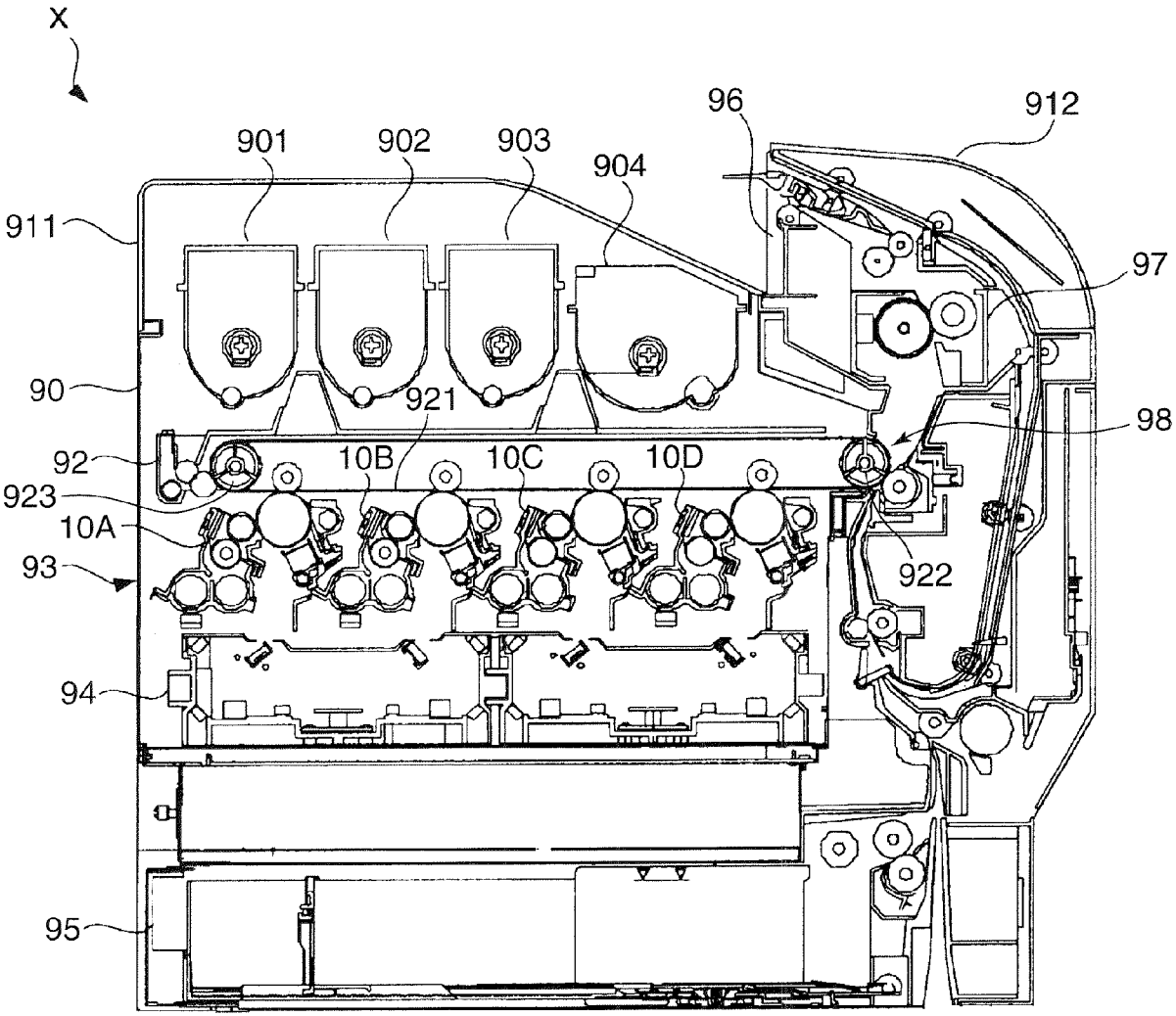
FIG. 2 is a sectional side view of the multicolor printer of FIG. 1.

FIG. 1 is an outer perspective view of a multicolor printer X according to an embodiment of an image forming apparatus of the present invention; and FIG. 2 is a sectional side view of the multicolor printer of FIG. 1, respectively. With reference to FIGS. 1 and 2, a general configuration of the multicolor printer X will now be described. The multicolor printer X here is a mere example of an image forming apparatus according to the present invention. The present invention can also be applied to a copying machine, a facsimile machine, a multifunction device of a combination thereof, and the like.

The multicolor printer X typically includes an image forming unit 93 having toner containers 901, 902, 903, 904, an intermediate transfer unit 92, a developing device 10 (10A, 10B, 10C, 10D), a laser scanner unit 94, a paper feeding cassette 95, a paper discharging unit 96, a fixing unit 97, an apparatus main body housing 90, a top cover 911, and a front cover 912. Here, the multicolor printer X also includes the other components which are usually provided in a typical multicolor printer such as a controlling circuit for controlling actions of the multicolor printer X.

The housing 90 is an outer body of the multicolor printer X. An inside of the housing 90 is provided with toner containers 901 through 904, the intermediate transfer unit 92, the image forming unit 93, and the laser scanner unit 94 in this order from the top to the bottom of the housing.

The top cover 911 serves as a covering member for covering a top surface of the housing 10 and also as a paper output tray on which a paper sheet after an image is formed is placed. A user or a service man attaches or detaches, or performs maintenance of the toner containers 901 through 904, the intermediate transfer unit 92, the image forming unit 93, and the laser scanner unit 94 from the top of the multicolor printer while the top cover 911 thereof is opened. On the other hand, the front cover 912 for covering a front surface side of the housing 90 is opened or closed when the paper discharge unit 96 and the fixing unit 97 are attached or detached, or during the maintenance of the multicolor printer.

The toner containers 901 through 904 contain toner (developer) of colors of Y (yellow), M (magenta), C (cyan), and K (black) and supply those colors of toner to the developing devices 10A through 10D of the image forming unit 93.

Figure 3:
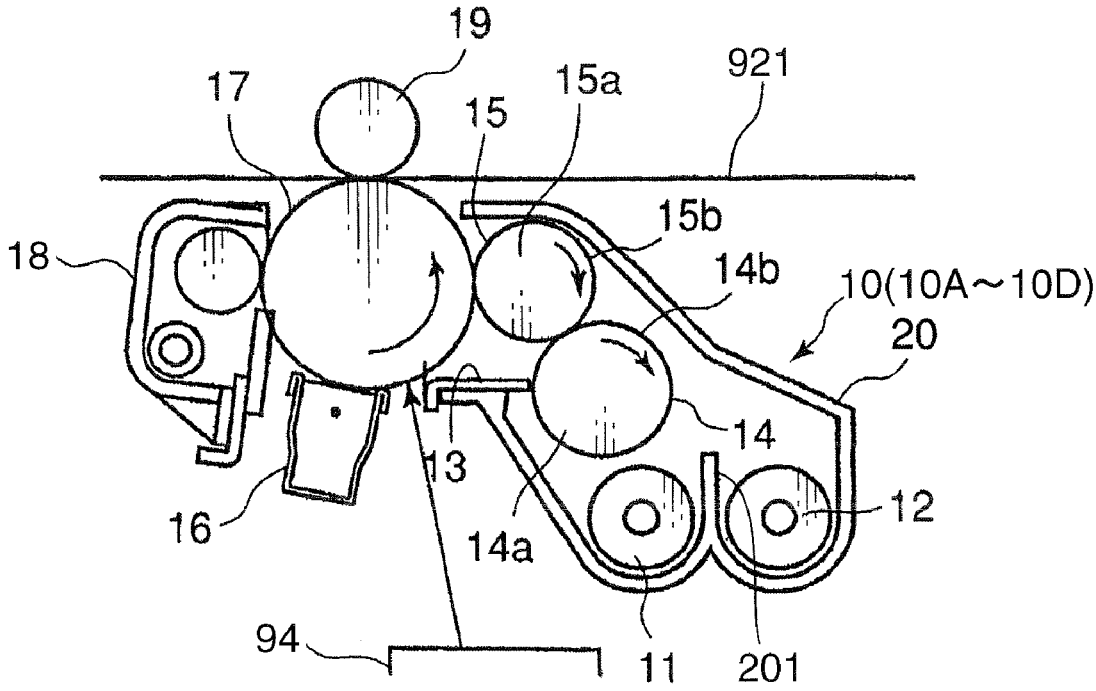
FIG. 3 is a schematic sectional view of an image forming portion.

The image forming unit 93 is placed below each of the toner containers 901 through 904 and has a plurality of image forming portions corresponding to each of the colors of Y, M, C, and K. FIG. 3 is a sectional view of an image forming portion. Because FIG. 3 is a schematic sectional view, the image forming portion illustrated in FIG. 3 has different configuration from that of FIG. 2. Each of the image forming portions is provided with a photoconductive drum 17 for carrying a toner image made of the respective colors of toner (a photoreceptor on which a latent image is formed through an electrophotograph method) in addition to the developing device 10 (10A through 10D). An amorphous silicon-made (a-Si) photoconductive drum can be used as the above photoconductive drum 17.

A periphery of the photoconductive drum 17 is provided with an charging device 16, the developing device 10, a transfer device (transfer roller) 19, a cleaning device 18, and the like. The charging device 16 uniformly charges a surface of the photoconductive drum 17. The surface of the photoconductive drum 17 having been electrically charged is exposed to light by the laser scanner unit 94 in order to form an electrostatic latent image. The developing device 10 develops (visualizes) the electrostatic latent image formed on each of the photoconductive drums 17 by using each colors of toner supplied from the toner containers 901 through 904. The transfer roller 19 pinches the intermediate transfer belt 921 together with the photoconductive drum 17 to form a nip portion, thereby performing a primary transfer of the toner image on the photoconductive drum 17 onto the intermediate transfer belt 921. The cleaning device 18 cleans the periphery of the photoconductive drum 17 after the transfer of the toner image.

The developing device 10 has a housing 20 in which a two component developer including a magnetic carrier and a toner is contained. The housing 20 includes therein two rotational agitating rollers 11, 12 (developer agitating members) which are placed in parallel to each other adjacent to the bottom portion of the housing oriented in an axis direction of the longitudinal direction of the housing. The agitating rollers 11, 12 are screw-shaped members with spiral blades provided on outer peripheries of rotation shafts of the rollers (see FIG. 5C).

An inner bottom surface of the housing 20 is provided a circular path for developer, and the agitating rollers 11, 12 are placed in the circular path. Along the axis direction of the housing between agitating rollers 11, 12, there is provided a partition wall 201 standing from the housing bottom portion. The partition wall 201 sections the circular path, and both ends of the partition wall in the axis direction are notched (see FIG. 5A) to form the circular path so as to encircle a periphery of the partition wall 201. The two-component developer is electrically charged while it is agitated and conveyed in this circular path by the agitating rollers 11, 12.

The magnetic roller 14 is placed above the agitating roller 11. Also, the developing roller (developer carrier) 15 is placed facing to the magnetic roller 14. The developing roller 15 is faced to the opening portion of the housing 20, through which developer is supplied, and a portion of the developing roller is exposed through the opening portion.

The magnetic roller 14 has a nonmagnetic rotation sleeve 14*b* encompassing a fixing magnet roller body 14*a* having a plurality of magnetic poles. For example, the rotation sleeve 14*b* is driven to rotate in a direction indicated by a solid line arrow in FIG. 3.

The developing roller 15 has a nonmagnetic rotation sleeve 15*b* encompassing a developing roller magnetic body 15*a* having one magnetic pole. The rotation sleeve 15*b* rotates in a direction opposite to a rotating direction of the rotation sleeve 14*b* at a position facing (opposing) to the magnetic roller 14 (A rotating direction of the rotation sleeve 15*b* is illustrated by a solid line arrow in FIG. 3).

The housing 20 is provided with a doctor blade 13 as a layer thickness regulating member of the developer at a position upstream of a position where the magnetic roller 14 and the developing roller 15 are opposed to each other along a longitudinal direction of the rotation sleeve 14*b* (a direction extending from a front side to a rear side of the paper in FIG. 3). A very thin space is created between a tip portion of the doctor blade 13 and a surface of the rotation sleeve 14*b*.

In the developing device 10 of FIG. 3, the two component developer is agitated by the agitating rollers 11 and 12 and circulated within the housing 20, thereby electrically charging the toner, and the two component developer on the agitating roller 11 is adsorbed and conveyed by the magnetic roller 14 positioned above the two component developer. Thus, adsorbed two-component developer forms a magnetic blush (not shown) on the magnetic roller 14, the magnetic blush is regulated of its layer thickness by the doctor blade 13, and a toner layer is formed on the developing roller 15 because of a difference in potential between the magnetic roller 14 and the developing roller 15. Accordingly, the electrostatic latent image on the photoconductive drum 17 is developed by the toner layer on the developing roller 15.

After the development has been completed, the toner layer remained on the developing roller 15 without being used for the development comes close to the magnetic roller 14 again at the position opposing to the magnetic roller 14. The toner layer at this opposing position is scraped out by a mechanical force of the magnetic blush made of the two-component developer.

The laser scanner unit 94 includes various optical devices such as a light source and a polygon mirror, a reflecting mirror, a deflecting mirror, and the like, and irradiates light based on image data to a periphery of the photoconductive drum 17 provided in each of the image forming portions to form the electrostatic latent image.

The intermediate transfer unit 92 includes an intermediate transfer belt 921, and driving rollers 922, 923. The intermediate transfer belt 921 receives the toner images from the plurality of photoconductive drums 17 in a superimposed manner via a primary transfer, and then thus received toner image is transferred to a paper sheet fed from the feeding cassette 95 in a secondary transfer portion 98 via a secondary transfer. The driving rollers 922, 923 drive the intermediate transfer belt 921 to rotate around them. The driving rollers 922, 923 are supported by the housing, not shown, in a rotation free manner.

The paper feeding cassette 95 keeps paper sheets on which images are to be formed and is detachably installed into the housing 90 from a side of the front cover 912.

The fixing unit 97 guides a paper sheet to the paper discharge unit 96 after a toner image having been secondary transferred from the intermediate transfer unit 92 is fixed onto the paper sheet. The fixing unit 97 has a heat roller, a pressure roller, and the others.

The paper discharge unit 96 discharges the paper sheet fed from the fixing unit 97 onto the top cover 911 serving also as the paper output tray. The paper discharge unit 96 includes a paper discharge roller for feeding the paper sheet.

Now, a configuration of the housing 20 of the developing device 10 will be described below. The current developing device holds rotational members such as the developing roller 15, the agitating rollers 11, 12, and the like, in a rotation free manner and is formed into a housing so as to pool the developer in a bottom portion thereof. This is because a dish shape is typical for the housing when considering a function for containing the developer. However, an idea of recycling efficiency is out of consideration in the current housing of the developing device and thus an idea of easy disassembly is also out of consideration when the housing is formed. Therefore, it is hard to disassemble the developing device having been used for a certain period of time, clean an interior of the housing of the developing device, and use it again.

A problem other than the above is heat caused by the friction of the developer. In the above developing device 10, frictional heat is caused by the friction between the developer and the doctor blade 13 for regulating the layer thickness of the developer, the friction between the developer and the surface of the rotation sleeve 14*b*, and the friction between the developer and the developer. There are such cases that this frictional heat causes a temperature rise of the developer, a poor developing ability of the developer, and deterioration of the developer thereby shortening its effective life. Especially, in the case of the two component developer, an additive added to the developer sinks into the softened toner and the magnetic carriers directly contact to each other to cause changes of shapes of magnetic carriers, thereby deteriorating the developer.

Also, the temperature of the toner constituting the developer rises due to the increased temperature of the developer to have the toner be softened and fused, thereby causing a toner filming in which the fused toner comes into a film to adhere to a surface of the developer carrier. Therefore, the property of the developer carrier is remarkably degraded and the temperature of a whole body of the printer X including the developing device 10 dramatically increases due to the increased temperature of the developer. As such, there may occur a problem in behavior or in an image quality of the printer X.

Accordingly, the present embodiment has such a configuration that the housing bottom portion of the developing device 10 where the developer is pooled can be separated from the housing upper portion including the developing roller 15 and the agitating rollers 11, 12, and the housing bottom portion is made of a high-thermal conductive resin member. With such a configuration, the interior of the housing can be cleaned with ease upon recycling by separating the housing bottom portion from the housing upper portion. Further, the heat of the developer pooled in the housing bottom portion can be efficiently released, and thus the above described problems such as the deterioration of the developing ability of the developer, and the like can be avoided.

The high-thermal conductive resin member is typically expensive, fragile, generally electrically conductive and has poor slidability. However, if only the housing bottom portion is made of the high-thermal conductive resin member, the cost of the developing device can be curbed comparing to the case where the whole housing is made of the high-thermal conductive resin member. The housing upper portion including the developing roller 15 and the agitating rollers 11, 12 can be made of a commonly used resin, such that no problems occur in insulation property and slidability.

Since the high-thermal conductive resin is fragile, it is preferred that the housing bottom portion and the housing upper portion are not coupled through screws or the like. Accordingly, the housing bottom portion and the housing upper portion are coupled to each other through a snap fit joint. With the snap fit joint, the developing device 10 can be disassembled without requiring special tools, and thus the working ability for recycling the developing device can be enhanced. Now, a configuration of the housing of the developing device 10 will be described in detail.

Figure 4:
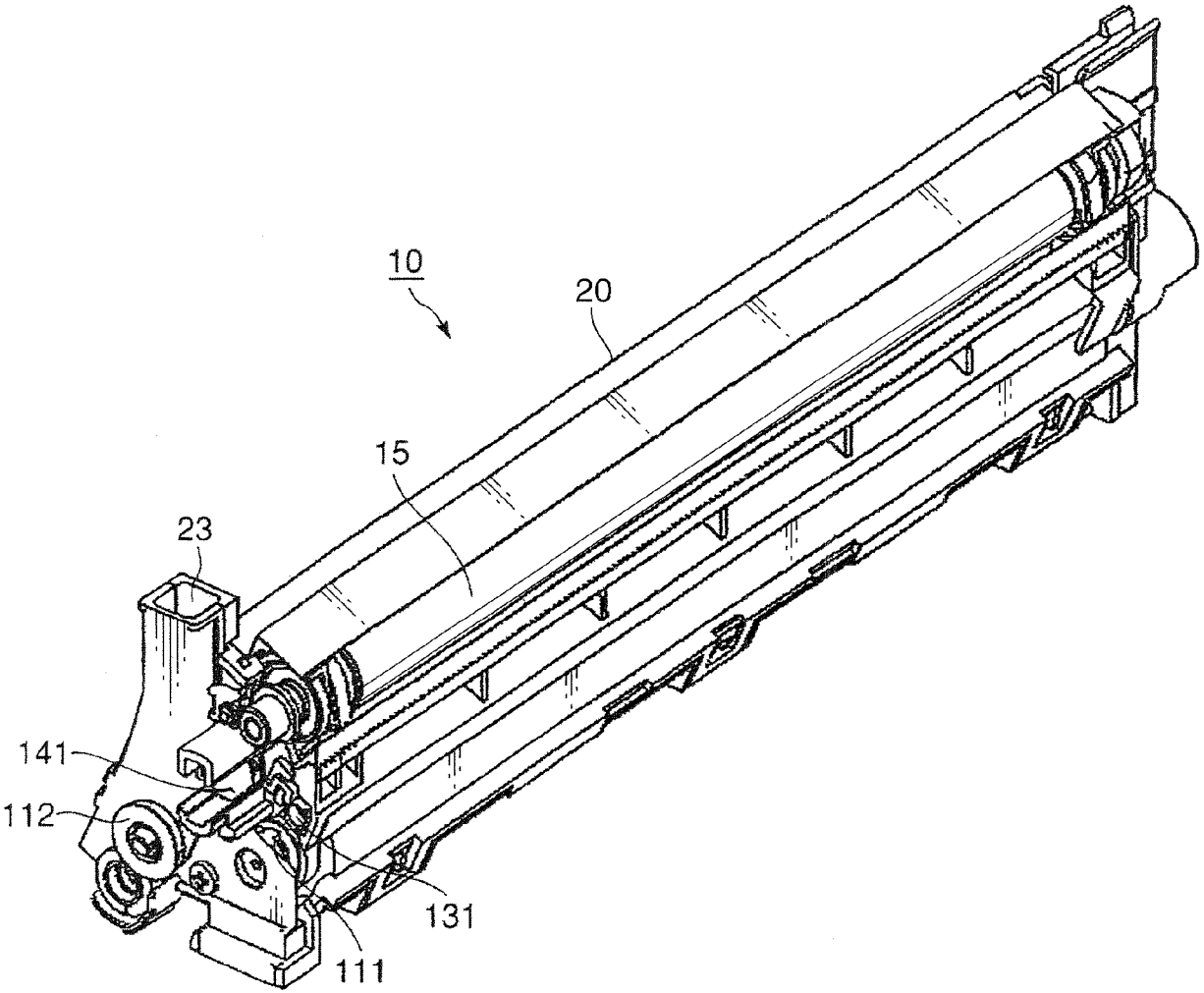
FIG. 4 is an outer perspective view of a developing device.

FIG. 4 is an outer perspective view of the developing device 10. The developing devices 11A through 11D for every colors of toner have almost the same configuration except for some minor differences. The developing device 10 is provided therein with the opening portion for supplying the developer through which the portion of the periphery of the developing roller 15 is exposed. This exposed portion is opposed to the periphery of the photoconductive drum 17.

At one end side of the developing device 10, there are provided gear mechanisms 111, 112 for causing a rotation of the above described agitating rollers 11, 12, an energizing hook 131 provided at an end of the doctor blade 13 in order to regulate the doctor blade 13 and the magnetic roller 14 to have the same potential, and a cover 141 for protecting a contacting point where a voltage is applied to a shaft of the magnetic roller 14. The one end side of the developing device 10 is further provided therein with a developer replenishing hole 23 for receiving the developer to be replenished to the housing 20 through a predetermined conveying path from any one of the toner containers 901 through 904.

Figures 5A, 5B, 5C:
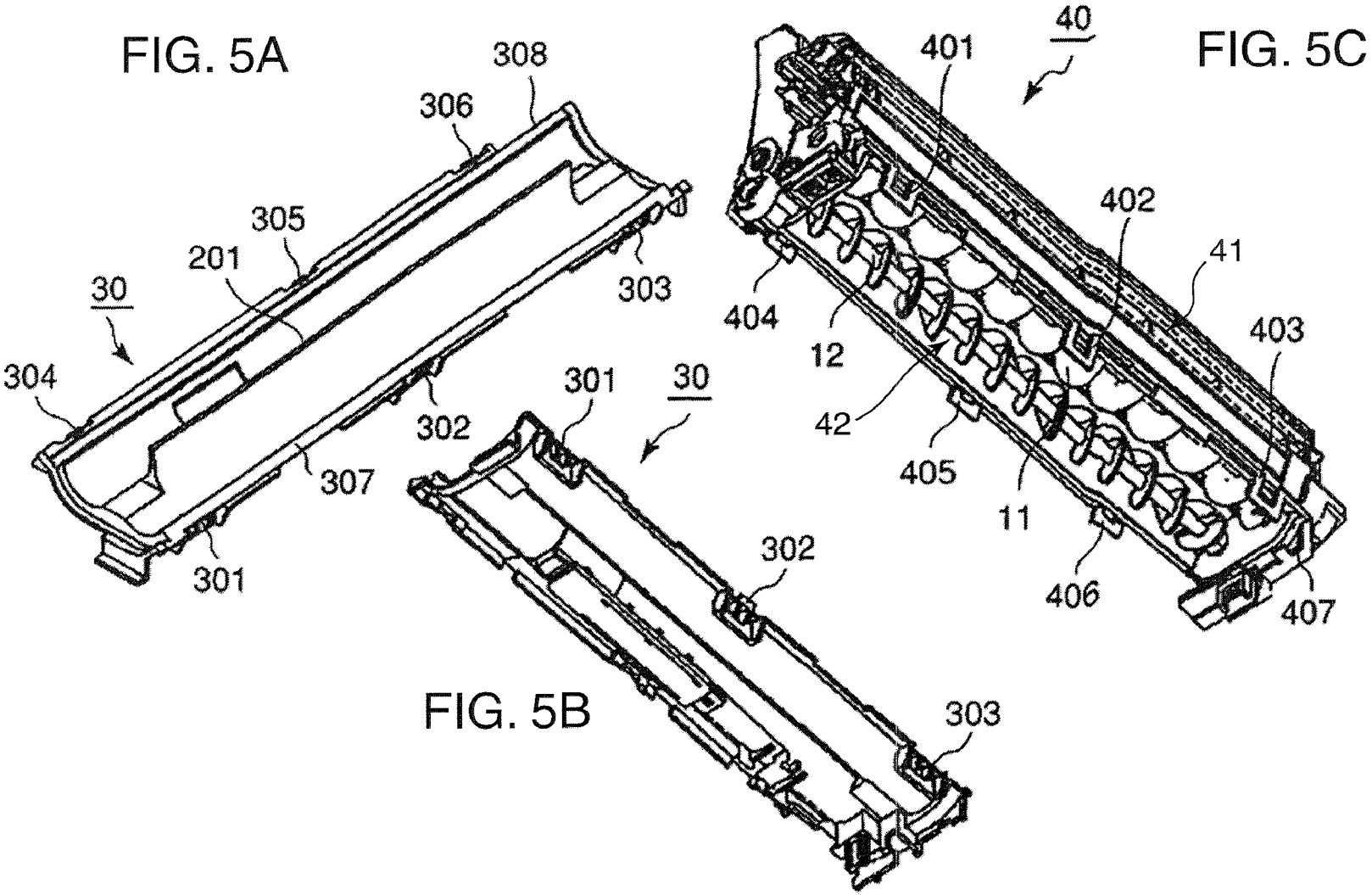
FIGS. 5A through 5C are exploded perspective views of the developing device.

FIGS. 5A through 5C are exploded perspective views of the developing device 10. The housing 20 of the developing device 10 is formed such that the housing upper portion piece 40 (first housing piece) and the housing bottom portion piece 30 (second housing piece) are detachably coupled to each other. Here, FIG. 5A is a perspective view of the housing bottom portion piece 30 viewed from an inner surface side thereof; FIG. 5B is a perspective view of the housing bottom portion piece 30 viewed from an outer surface side; and FIG. 5C is a perspective view of the housing upper portion piece 40 viewed from a bottom portion side, respectively.

The housing upper portion piece 40 is provided in its upper portion with an opening portion 41 for supplying the developer to the photoconductive drum 17 and at its bottom surface side a sealed opening portion 42 to be sealed by the housing bottom portion piece 30 on the bottom surface side. The two agitating rollers 11, 12 are placed facing to the sealed opening portion 42 and are exposed to the outside when the housing bottom portion piece 30 is removed (FIG. 5C). Both side end walls of the housing upper portion piece 40 supports the agitating rollers 11, 12, the magnetic roller 14, and the developing roller 15 in a rotational manner.

The housing bottom portion piece 30 is a member having a generally rectangular shape in the axis direction and is coupled to the housing upper portion piece 40 through the snap fit joint so as to seal the sealed opening portion 42. The developer replenished through the developer replenishing hole 23 comes to be pooled inside the housing bottom portion piece 30. As described above, when the housing bottom portion piece 30 is coupled to the housing upper portion piece 40, since the partition wall 201 interpositioned between the agitating rollers 11 and 12 projects toward the inside of the housing bottom portion piece 30, thus pooled developer is circulatingly conveyed through the conveying path sectioned by the partition wall 201 by means of the agitating rollers 11, 12.

The housing bottom portion piece 30 is formed of a resin member having an excellent thermal conductivity. Such resin member includes a thermoplastic resin filled with filler for enhancing the thermal conductivity thereof. Here, examples of the thermoplastic resin include an acrylonitrile butadiene styrene (ABS) resin, a polyphenylene sulfide (PPS) resin, a polyether sulfone (PES) resin, a polybutylene terephthalate (PBT) resin, a polyether resin, a modified polyphenylene ether resin, or the like. Also, metal powder, more preferably, a metal filler having a low melting point can be used as the filler. A preferable thermal conductive rate of the resin member is equal to or grater than 1 W/(m□K).

As has been described above, since the housing bottom portion piece 30 is made of the resin member having the high-thermal conductivity, the frictional heat of the developer can be released efficiently. Therefore, even if the frictional heat would occur due to the friction between the developer and the doctor blade 13 for regulating the layer thickness of the developer, the friction between the developer and the rotational sleeve 14*b*, and the friction between the developer and the developer, the frictional heat will be released through the housing bottom portion piece 30, such that the problems of the poor developing ability of the developer, deterioration of the developer, sinking of the additive added to the developer into the toner particles in the two-component developer including toner particles and magnetic carriers, and deterioration of the developer due to a change of shapes of the magnetic carriers caused by direct contact between the magnetic carriers will be prevented from occurring. Also, since not a small amount of developer comes to contact the partition wall 201, the heat releasing efficiency can be further enhanced.

As shown in FIGS. 5A and 5B, one side edge in the longitudinal direction of the housing bottom portion piece 30 is provided with three first claw portions 301, 302, 303 almost equally spaced apart to each other. Also, the opposed side edge in the longitudinal direction of the housing bottom portion piece 30 is provided with three second claw portions 304, 305, 306 substantially equally spaced apart to each other. On the other hand, the one side edge in the longitudinal direction of the sealed opening portion 42 of the housing upper portion piece 40 is provided with projecting first snap fit joints 401, 402, 403 so as to correspond to the first claw portions 301, 302, 303. Also, the other side edge in the longitudinal direction is provided with second snap fit joints 404, 405, 406 so as to correspond to the respective second claw portions 304, 305, 306.

Figure 6A:
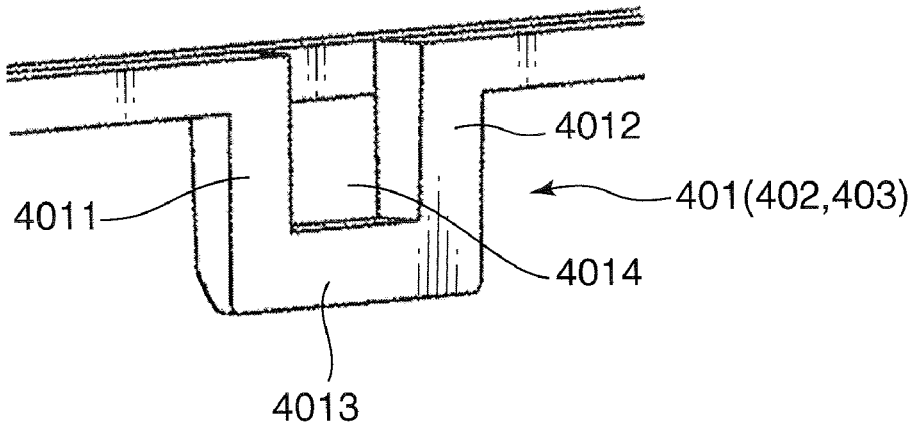
FIGS. 6A and 6B are partial perspective views illustrating a first example of a snap fit coupling portion.
Figure 6B:
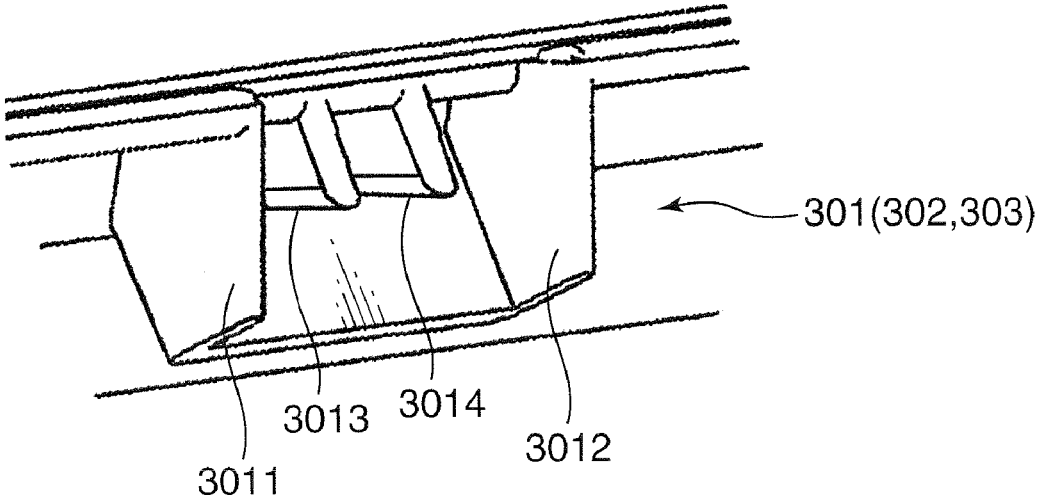

FIG. 6A is an enlarged perspective view of the first snap fit joint 401 (402, 403); and FIG. 6B is an enlarged perspective view of the first claw portion 301, (302, 303), respectively. The first snap fit joint 401, having a hollow center 4014, is a hooking fastener member comprising a pair of projecting pieces 4011, 4012 projecting downward from a side edge of the sealed opening portion 42 and a horizontal piece 4013 which bridges the tips of the projecting pieces 4011, 4012. The first snap fit joint 401 can be deformed by applying a widening force to the horizontal piece 4013 by means of a finger or the like.

The first claw portion 301 includes a pair of guide walls 3011, 3012 provided on a side edge of the housing bottom portion piece 30, and a pair of retaining pieces 3013, 3014 projecting between the guide walls 3011 and 3012. When the housing bottom portion piece 30 and the housing upper portion piece 40 are coupled to each other, the guide walls 3011, 3012 guide the projecting pieces 4011, 4012 of the first snap fit joint 401 thereby allowing the retaining pieces 3013, 3014 to fit into the hollow center 4014 while the projecting pieces 4011, 4012 are flexing. As such, the both are coupled to each other through the snap fit joint.

Figure 7A:
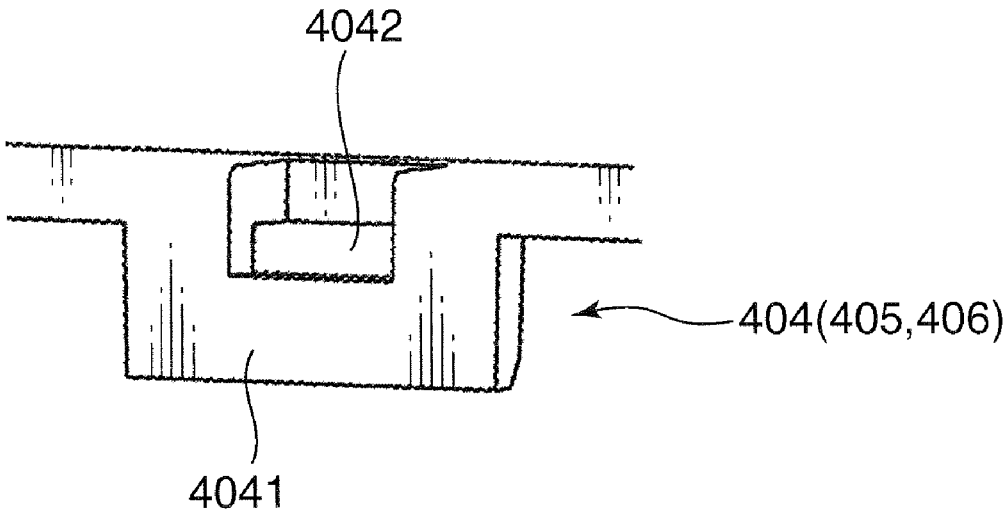
FIGS. 7A and 7B are partial perspective views illustrating a second example of the snap fit coupling portion.
Figure 7B:
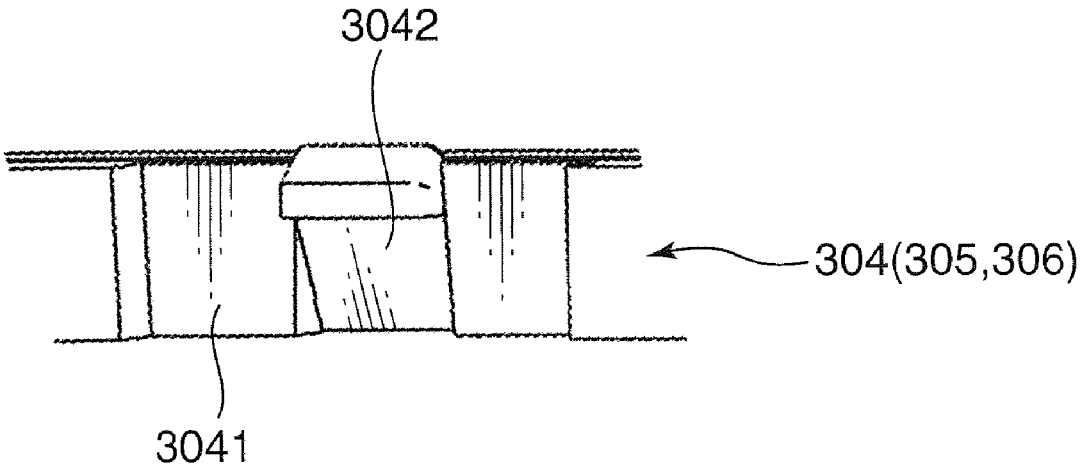

FIG. 7A is an enlarged perspective view of the second snap fit joint 404 (405, 406); and FIG. 7B is an enlarged perspective view of the second claw portion 304 (305, 306), respectively. The second snap fit joint 404 comprises a hooking fastener piece 4041 projecting downward from a side edge of the sealed opening portion 42 and encloses a hollow center 4042. The hooking fastener piece 4041 also can be deformed. The second claw portion 304 includes a concave portion 3041 provided on a side edge of the housing bottom portion piece 30 and a retaining portion 3042 projecting from a center of the concave portion 3041. When the housing bottom portion piece 30 and the housing upper portion piece 40 are coupled to each other, the hooking fastener piece 4041 is retained within the concave portion 3041 and the hollow center 4042 receives the retaining portion 3042 while the hooking fastener piece 4041 is flexing, thereby creating a snap fit joint coupling therebetween.

A user can release the respective coupling condition between the first claw portions 301 through 303 and the second claw portions 304 through 306 to remove the housing bottom portion piece 30 from the housing upper portion piece 40 by outwardly deforming the first snap fit joints 401 through 403 and the second snap fit joints 404 through 406. Accordingly, the inner surface sides of the housing bottom portion piece 30 and the housing upper portion piece 40 can be exposed with ease, and therefore detachment or attachment of the rotational members such as the developing roller 15 and the agitating rollers 11, 12 and cleaning of the housing internal surfaces can be carried out with ease.

Figure 8:
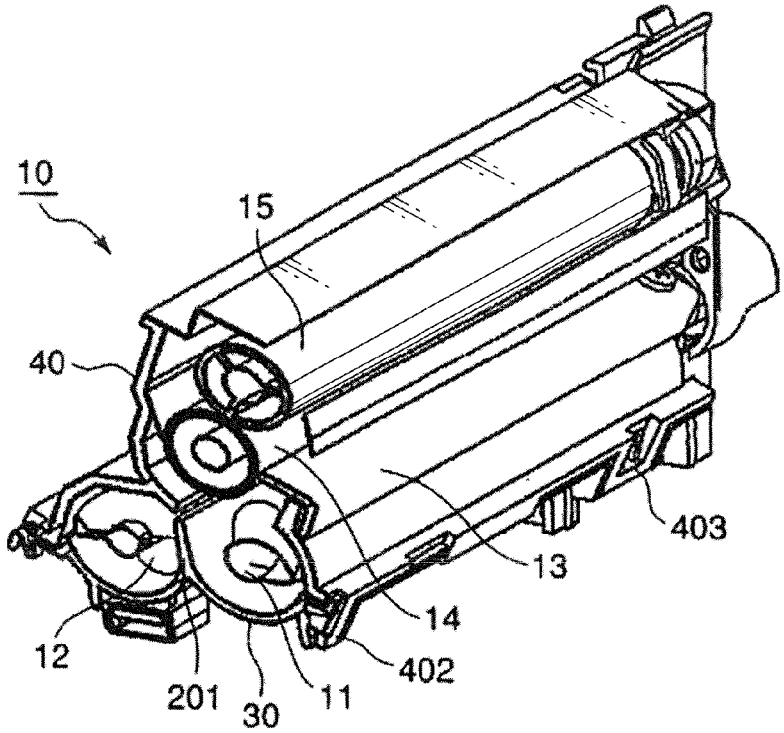
FIG. 8 is a perspective view illustrating that a combined housing bottom portion and housing upper portion of the developing device housing is cut at around a center thereof.
Figure 9:
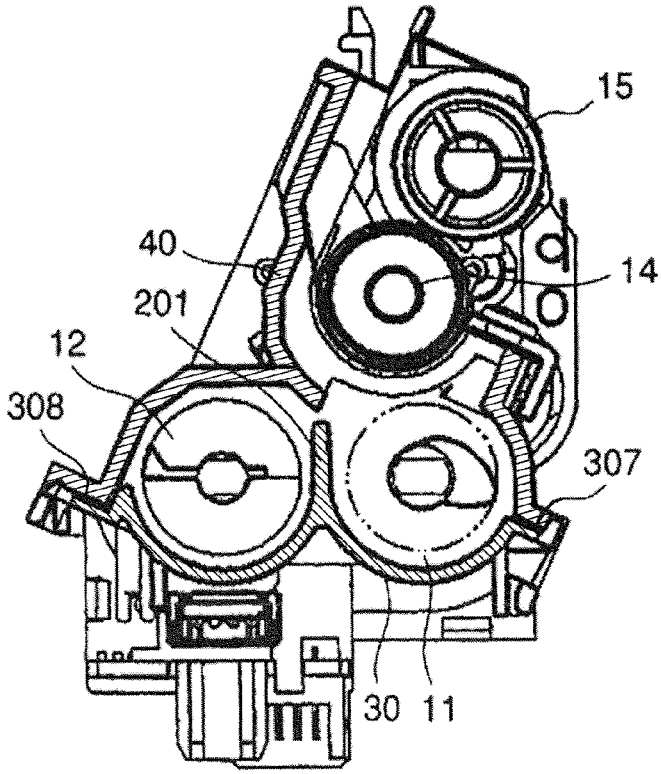
FIG. 9 is a front view of the cut cross section thereof, respectively.

FIG. 8 is a perspective view of the housing bottom portion piece 30 and the housing upper portion piece 40 being coupled to each other through the snap fit joint and cut around the center thereof; and FIG. 9 is a front view of the cut cross sectional surface thereof, respectively. As shown in FIGS. 8 and 9, the developing roller 15 is placed on the uppermost section in their figures, the magnetic roller 14 and the doctor blade 13 are placed below the developing roller 15, the agitating roller 11 is placed below the magnetic roller 14, and the agitating roller 12 is placed next to the agitating roller 11.

Two arc-shaped surfaces are provided inside the housing bottom portion piece 30 placing the partition wall 201 therebetween so as to conform to the outer shapes of the agitating rollers 11, 12 which are made of screw shape members. Accordingly, the developer circular path of a general spectacle shape in its cross section is formed inside the housing.

According to the present embodiment, the housing upper portion piece 40 and the housing bottom portion piece 30 are separable to each other, such that there is such a possibility that the developer pooled in the housing bottom portion piece 30 may leak. To resolve that potential problem, sealing members 307, 308 are interpositioned between the mating portions of the housing upper portion piece 40 and the housing bottom portion piece 30. For example, a sponge seal may be used as the sealing members 307, 308.

Figure 10:
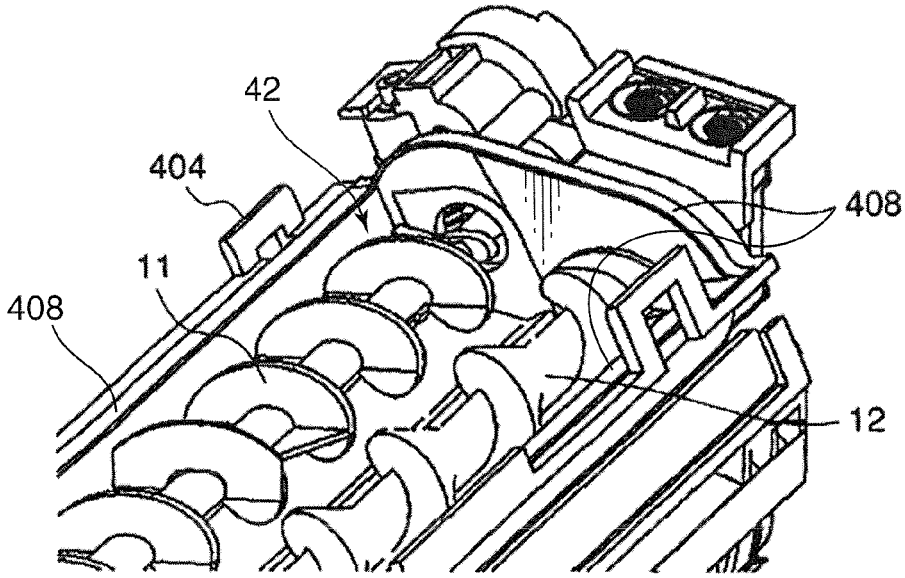
FIGS. 10 and 11 are perspective views illustrating a position at which a sealing member is sealed onto the housing upper portion side.
Figure 11:
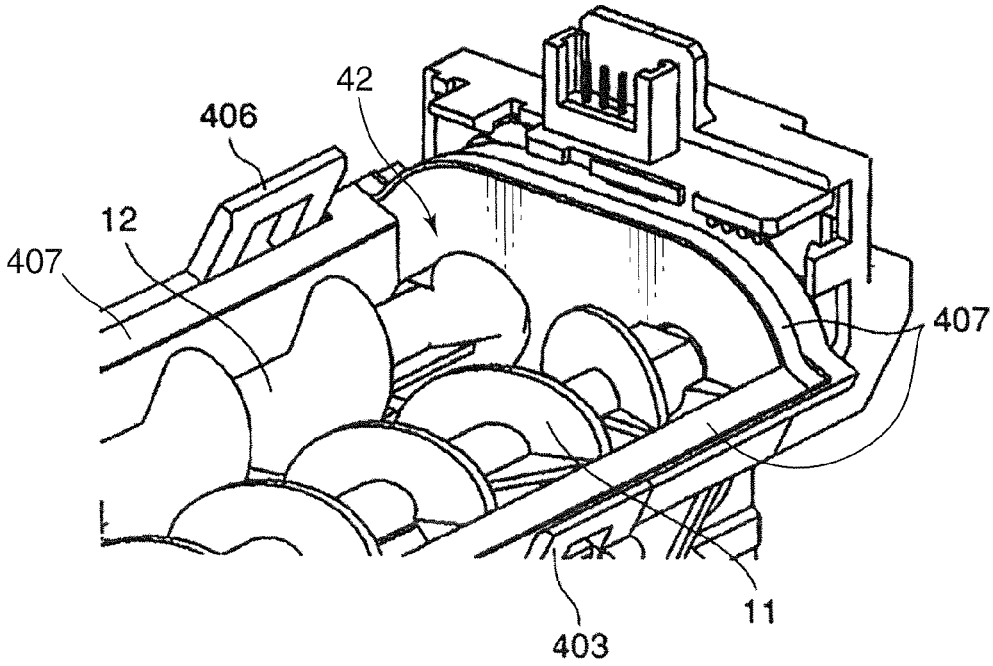

FIGS. 10, 11 are partial perspective views of an attachment portion of the sealing members 307, 308. FIG. 10 illustrates a left side end portion in an axis direction of the housing upper portion piece 40 of FIG. 5C; and FIG. 11 illustrates a right side end portion in the axis direction of the housing upper portion piece of FIG. 5C, respectively. As shown in FIGS. 10 and 11, a peripheral edge of the sealed opening portion 42 of the housing upper portion piece 40 is provided with flanges 407, 408. The sealing members 307, 308 are adhered onto the flanges 407, 408. When the housing upper portion piece 40 and the housing bottom portion piece 30 are coupled to each other through the snap fit joint, the sealing members 307, 308 serve to prevent the developer from leaking.

Figure 12:
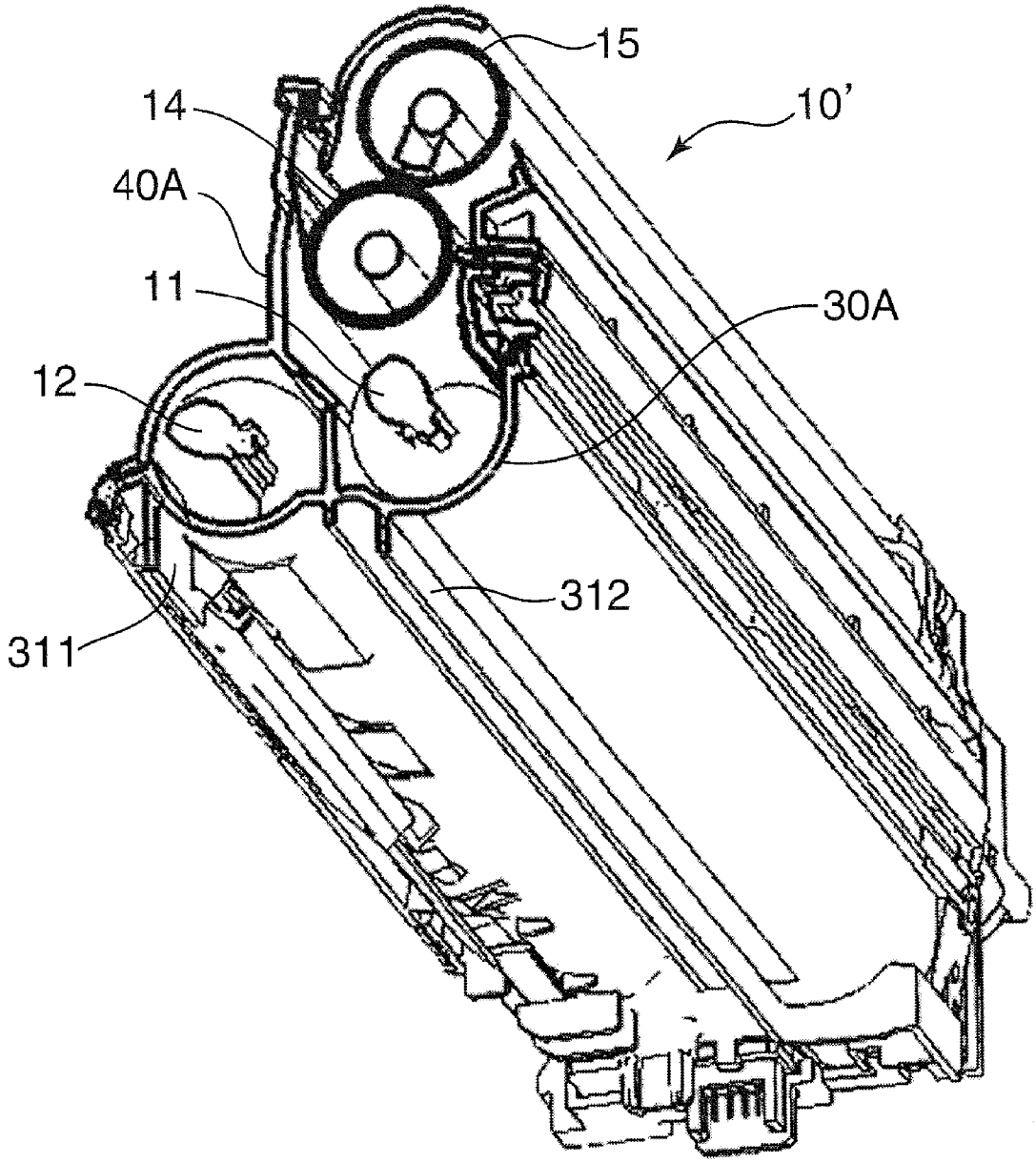
FIG. 12 is a perspective view of the developing device according to a modified embodiment cut in the adjacent to an end portion thereof.
Figure 13:
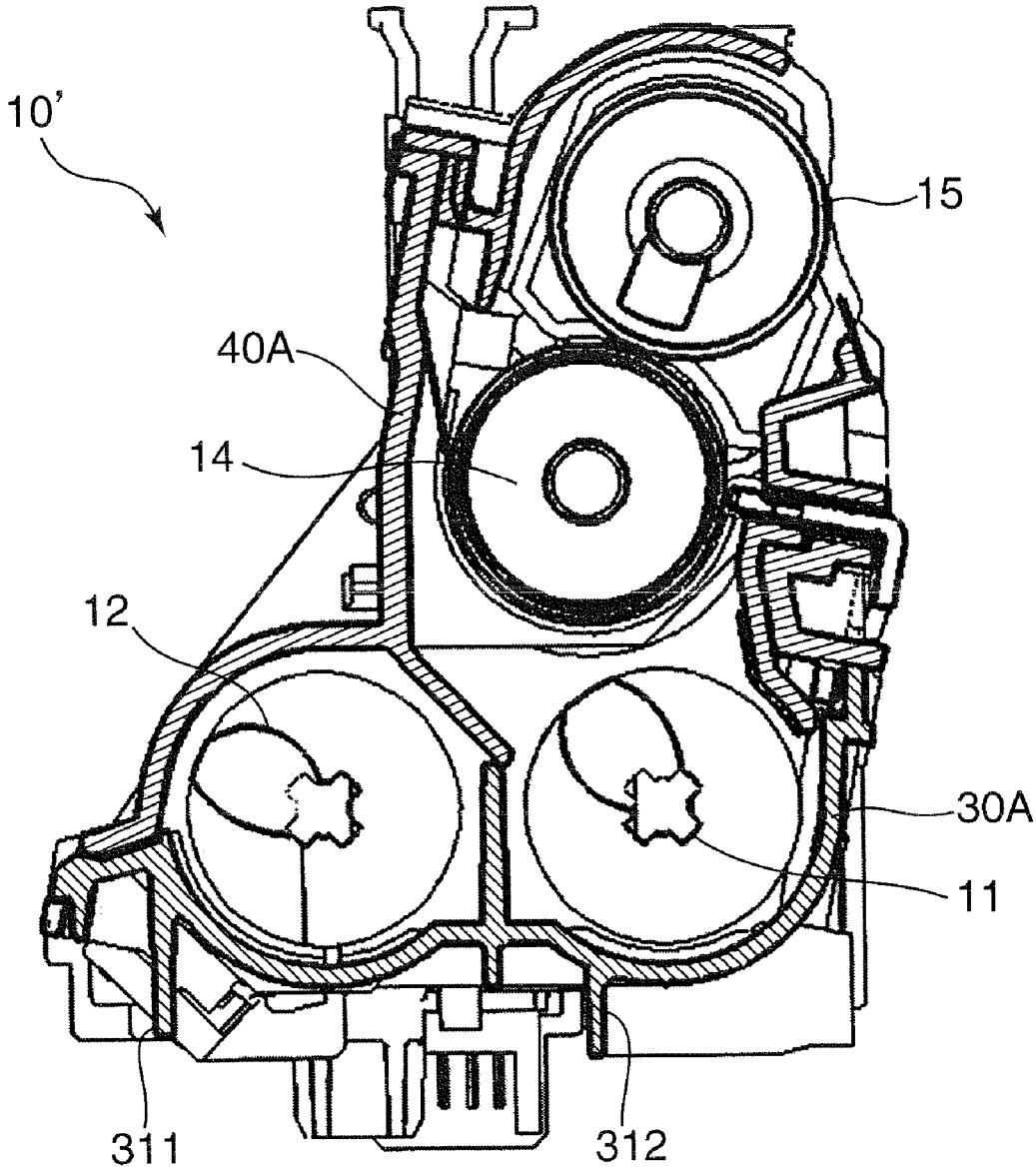
FIG. 13 is a front view of the cut cross section thereof, respectively.
Figure 14:
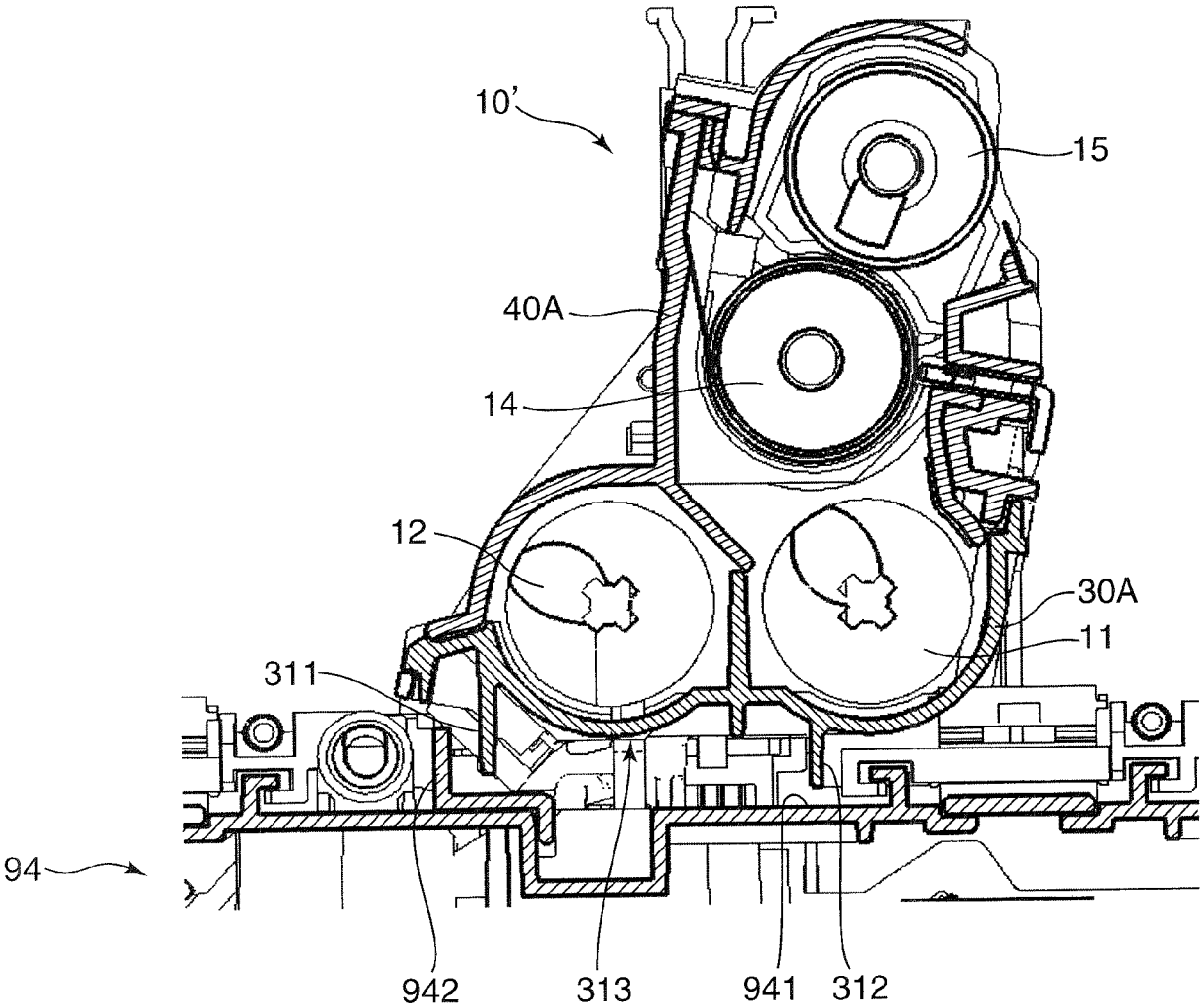
FIG. 14 is a partial perspective view illustrating that the developing device according to the modified embodiment is installed into the printer.

Now, a developing device 10' according to a modified embodiment will be described with reference to FIGS. 12 through 14. FIG. 12 is a perspective view of the developing device 10' cut in the adjacent to an end of the developing device; and FIG. 13 is a front view of the sectional view, respectively. FIG. 14 is a partial sectional view of the developing device 10' installed within the printer X.

The developing device 10' has such a housing configuration similar to the above described embodiment that the housing upper portion piece 40A and the housing bottom portion piece 30A are coupled to each other through the snap fit joint; however, the housing configuration is different from the above developing device 10 in that a first rib 311 and a second rib 312 project from an outer side surface of the housing bottom portion piece 30A. The first rib 311 and the second rib 312 are projections extending in a longitudinal direction of the developing device 10' and in parallel with each other. The first rib 311 and the second rib 312 are formed into projections, such that a surface area of an outer side surface of the housing bottom portion piece 30A increases to enhance the heat releasing efficiency. Therefore, even if the developer pooled within the housing bottom portion piece 30A produces heat, the heat can be released by the first rib 311 and the second rib 312 which are serving as so-called radiation fins.

The first rib 311 and the second rib 312 not only serve as the radiation fins but also serve as partitions for sectioning an air path through which cooled wind passes. As shown in FIG. 14, a laser scanner unit 94 is placed below the developing device 10'. The first rib 311 and the second rib 312 project toward a scanner housing 941 of the laser scanner unit 94, resulting in creating an almost enclosed space by the first rib 311, the second rib 312, an outer side surface 313 of the housing bottom portion piece 30A, and the scanner housing 941. Further, the scanner housing 941 is provided with a rib 942 projecting therefrom so as to enhance the enclosing property of the above enclosed space.

The enclosed space functions as a duct which allows the cooled wind to pass therethrough. The housing bottom portion piece 30A can be cooled efficiently by distributing the cooled wind sent to the duct from a blower, not shown. Especially, the first rib 311 and the second rib 312 serving as the radiation fins are used as partitions for sectioning the duct, such that more cooling efficiency can be produced.

The embodiment described above encompasses inventions having the configurations described below.

The developing device according to one aspect of the present invention includes: a housing with an opening portion for supplying developer; a developer carrier rotatably placed within the housing so as to expose a portion of the developer carrier through the opening portion; and a developer agitating member rotatably placed within the housing in order to agitate and electrically charge the developer. The housing is formed such that a first housing piece and a second housing piece are coupled to each other in a detachable manner. The first housing piece is provided therein with the opening portion and the sealed opening portion and supports the developer carrier and the developer agitating member in a rotational manner, and the second housing piece is coupled to the first housing piece so as to seal the sealed opening portion, and the first housing piece and the second housing piece are coupled to each other through the snap fit joint.

The image forming apparatus with the developing device having the above described configuration according to another aspect of the present invention includes: a photoreceptor on which a latent image is formed by an electrophotography method, and a developing device for supplying developer to the photoreceptor.

With the above-described configuration, the first housing piece and the second housing piece are coupled to each other through the snap fit joint and thus can be attached or detached with ease, such that the housing of the developing device can be disassembled with ease. Therefore, since the second housing piece can be removed to clean the inside thereof when it is subjected to recycle, the developing device or the image forming apparatus having an excellent recycling working ability can be provided.

In the above-described configuration, it is preferable that the second housing piece is made of a resin having high-thermal conductivity.

According to the above configuration, since the second housing piece having a large contact area with the developer can release the heat of the developer, the developer can be efficiently cooled. Therefore, the problems of the poor developing property of the developer, the deterioration of the developer due to softening of the additive in the two component developer, and a toner filming can be prevented from occurring.

The resin having the high-thermal conductivity is generally expensive; however the cost can be held down if only the second housing piece which can most efficiently release the heat of the developer is formed of the high-thermal conductive resin and the first housing piece which has less expectation to release heat is formed of the conventional resin.

In the above configuration, it is preferable that the developer agitating member is placed facing to the sealed opening portion of the first housing piece. Accordingly, the developer agitating member can be immediately exposed upon removal of the second housing piece, such that removal and cleaning of the developer agitating member can be performed with ease.

In the above configuration, it is preferable to include the first agitating member and the second agitating member placed in parallel with each other as the developer agitating members, and a partition wall interpositioned between the first agitating member and the second agitating member on an inner surface side of the second housing piece while the second housing piece is coupled with the first housing piece. With the above configuration, the circular path of the developer can be sectioned by the partition wall and the developer can be cooled more efficiently by using the partition wall having secondly large contacting area with the developer.

In the above configuration, it is preferable that the first agitating member and the second agitating member include screw-shaped members, and the inner surface side of the second housing piece is provided with an arc-shaped surface conforming to the screw shape. With such a configuration, the developer can be agitated and conveyed efficiently.

In the above configuration, it is preferable to further include a sealing member interpositioned between the first housing piece and the second housing piece, in which the first housing piece and the second housing piece have flanges respectively to allow the flanges to mate with each other, and the sealing member is interpositioned between the flanges. With such a configuration, the toner can be prevented from leaking.

In the above configuration, it is preferable that a rib which enhances the heat releasing property is provided on an outer surface side of the second housing piece projecting therefrom. Especially, it is preferable that the configuration further includes a unit member to be placed next to the second housing piece of the developing device, in which the rib which enhances the heat releasing property is provided projecting from the outer surface side of the second housing piece, and the rib and the outer surface of the second housing piece, and an outer surface of the unit member serve to section a path through which air flows. With such a configuration, the heat releasing property of the second housing piece can be enhanced by the rib and a ventilation duct for cooled wind can be configured by using the rib, thereby further improving the heat releasing property.

In the above configuration, it is preferred to further comprise a magnetic roller which is rotatably supported by the first housing piece and placed between the developer carrier and the developer agitating member. Because of the configuration, the present invention is applicable to the developing device using the two component developer.

It is preferred that the opening portion is defined in the upper portion of the first housing piece while the sealed opening portion is defined in a bottom surface side of the first housing piece; the developer agitating member is placed facing to the sealed opening portion provided on the bottom surface side through which the developer is circulatingly conveyed; and the second housing piece has an internal surface which comprises a lower half of the path through which the developer is conveyed to circulate while the second housing piece is coupled with the first housing piece.

This application is based on patent application No. 2007-035557 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A developing device to be attached to an image forming apparatus having a photoreceptor, comprising:

a first housing piece formed with a developer opening for supplying developer in an upper portion thereof and a bottom opening in a bottom portion thereof, the developer opening facing the photoreceptor;

a developer carrier rotatably supported by the first housing piece, a portion of the developer carrier exposing through the developer opening;

a developer agitating member rotatably supported by the first housing piece to agitate and electrically charge the developer, an axis of the developer agitating member being below an axis of the developer carrier and the developer opening;

a second housing piece made of resin having high-thermal conductivity and detachably coupled to the first housing piece so as to seal the bottom opening of the first housing piece;

the first housing piece and the second housing piece being coupled to each other through a snap fit joint.

2. The developing device according to claim 1, wherein the developer agitating member is placed facing to the bottom opening of the first housing piece.

3. The developing device according to claim 2, wherein the developer agitating member is a first developer agitating member, the developing device further comprising:

a second agitating member placed in parallel with the first developer agitating member;

wherein an inner surface side of the second housing piece is provided with a partition wall interpositioned between the first developer agitating member and the second developer agitating member while the second housing piece is coupled with the first housing piece.

4. The developing device according to claim 3, wherein each of the first developer agitating member and the second developer includes a screw-shaped member, and the inner surface side of the second housing piece includes an arc-shaped surface conforming to the screw shape.

5. The developing device according to claim 1, further comprising:

a sealing member interpositioned between the first housing piece and the second housing piece;

wherein each of the first housing piece and the second housing piece includes a flange, and the sealing member is interpositioned between the flanges of the first and second housing pieces.

6. The developing device according to claim 1, wherein a rib that enhances a heat releasing property is provided on an outer surface side of the second housing piece so as to project therefrom.

7. The developing device according to claim 1, further comprising:

a magnetic roller which is rotatably supported by the first housing piece and placed between the developer carrier and the developer agitating member.

8. The developing device according to claim 1, wherein the developer agitating member is placed facing to the bottom opening and circulates the developer through the bottom portion of the first housing piece; and the second housing piece has an inner surface comprising a bottom half of a path through which the developer is circulatingly conveyed while the second housing piece is coupled with the first housing piece.

9. An image forming apparatus comprising:

a photoreceptor on which a latent image is formed through an electrophotography method; and a developing device for supplying developer to the photoreceptor;

wherein the developing device includes:

a first housing piece formed with a developer opening for supplying developer in an upper portion thereof and a bottom opening in a bottom portion thereof, the developer opening facing the photoreceptor;

a developer carrier rotatably supported by the first housing piece, a portion of the developer carrier exposing through the developer opening;

a developer agitating member rotatably supported by the first housing piece to agitate and electrically charge the developer, an axis of the developer agitating member being below an axis of the developer carrier and the developer opening;

a second housing piece made of resin having high-thermal conductivity and detachably coupled to the first housing piece so as to seal the bottom opening of the first housing piece;

the first housing piece and the second housing piece being coupled to each other through a snap fit joint.

10. The developing device according to claim 9, wherein the developer agitating member is placed facing to the bottom opening of the first housing piece.

11. The image forming apparatus according to claim 10, wherein the developer agitating member is a first developer agitating member, the image forming apparatus further comprising:

a second agitating member placed in parallel with the first developer agitating member;

wherein an inner surface side of the second housing piece is provided with a partition wall interpositioned between the first developer agitating member and the second developer agitating member while the second housing piece is coupled with the first housing piece.

12. The image forming apparatus according to claim 11, wherein each of the first developer agitating member and the second developer includes a screw-shaped member, and the inner surface side of the second housing piece includes an arc-shaped surface conforming to the screw shape.

13. The image forming apparatus according to claim 9, further comprising:

a sealing member interpositioned between the first housing piece and the second housing piece;

wherein each of the first housing piece and the second housing piece includes a flange, and the sealing member is interpositioned between the flanges of the first and second housing pieces.

14. The image forming apparatus according to claim 9, further comprising:

a unit member placed next to the second housing piece of the developing device;

wherein an outer surface side of the second housing piece is provided with a rib which enhances the heat releasing property so as to project therefrom; and a combination of the rib, an outer surface of the second housing piece, and an outer surface of the unit member defines an air flow path.

15. The image forming apparatus according to claim 9, further comprising a magnetic roller which is rotatably supported by the first housing piece and placed between the developer carrier and the developer agitating member.

16. The image forming apparatus according to claim 9, the developer agitating member is placed facing to the bottom opening and circulates the developer through the bottom portion of the first housing piece; and the second housing piece has an inner surface comprising a bottom half of a path through which the developer is circulatingly conveyed while the second housing piece is coupled with the first housing piece.

17. The developing device according to claim 1, wherein the bottom opening in the first housing piece is gravitationally lower than the developer opening in the first housing piece.

18. The image forming apparatus according to claim 9, wherein the bottom opening in the first housing piece is gravitationally lower than the developer opening in the first housing piece.

* * * * *